United States Patent [19]

Lingaraju et al.

[11] Patent Number: 4,698,894

[45] Date of Patent: Oct. 13, 1987

[54] QUICK CHANGE DIE RETENTION APPARATUS

[75] Inventors: Bhartoor H. Lingaraju, Allentown; Robert J. Kuntz, Ancient Oak Macungie, both of Pa.

[73] Assignee: Hubbell-Bell Inc., Orange, Conn.

[21] Appl. No.: 859,195

[22] Filed: Apr. 28, 1986

Related U.S. Application Data

[63] Continuation of Ser. No. 627,164, Jul. 2, 1984, abandoned.

[51] Int. Cl.[4] ..... B23Q 3/00; B21J 13/00; B21D 37/04

[52] U.S. Cl. ..... 29/464; 72/446; 72/481; 100/918

[58] Field of Search ..... 72/446, 447, 481; 100/915, 918; 29/464, 465, 466, 467, 468; 33/181 R, 180 R, 15 R

[56] References Cited

U.S. PATENT DOCUMENTS

| | | | |
|---|---|---|---|
| 2,781,016 | 2/1957 | Livermont | 72/481 |
| 2,984,176 | 5/1961 | Sommer et al. | 100/918 X |
| 3,075,416 | 1/1963 | Stahldneher | 72/481 X |
| 3,269,168 | 8/1966 | Anderson | 72/481 |
| 3,834,217 | 9/1974 | Ducate | 72/446 |
| 3,848,494 | 11/1974 | Gargrave et al. | 100/918 X |
| 3,881,343 | 5/1975 | Ducate | 72/481 |
| 4,187,713 | 2/1980 | Bellner | 72/446 |

FOREIGN PATENT DOCUMENTS

| | | | |
|---|---|---|---|
| 150153 | 8/1981 | German Democratic Rep. | 72/481 |
| 8918 | 3/1970 | Japan | 100/918 |

*Primary Examiner*—Howard N. Goldberg
*Assistant Examiner*—Steven Nichols
*Attorney, Agent, or Firm*—S. A. Litchfield

[57] ABSTRACT

This disclosure depicts a novel method and apparatus for aligning and locating a die set in a press used in the manufacture of materials. In particular, this method and apparatus is intended for locating a die set with respect to a bolster plate or bed and with respect to a ram of a punch press for securely clamping the die set on the bolster and ram. The method comprises mating a keyway cut in a lower die plate with a corresponding key fixed on the bolster plate and hydraulically clamping the die set to the bolster plate and ram once mated. The hydraulic clamping is accomplished by moving a hydraulic clamp in a T-slot on the bolster plate until the clamp contacts a receiving area on the die set, and then activating the hydraulic clamp. The apparatus is disclosed for implementing the described method.

4 Claims, 11 Drawing Figures

FIG. 8.
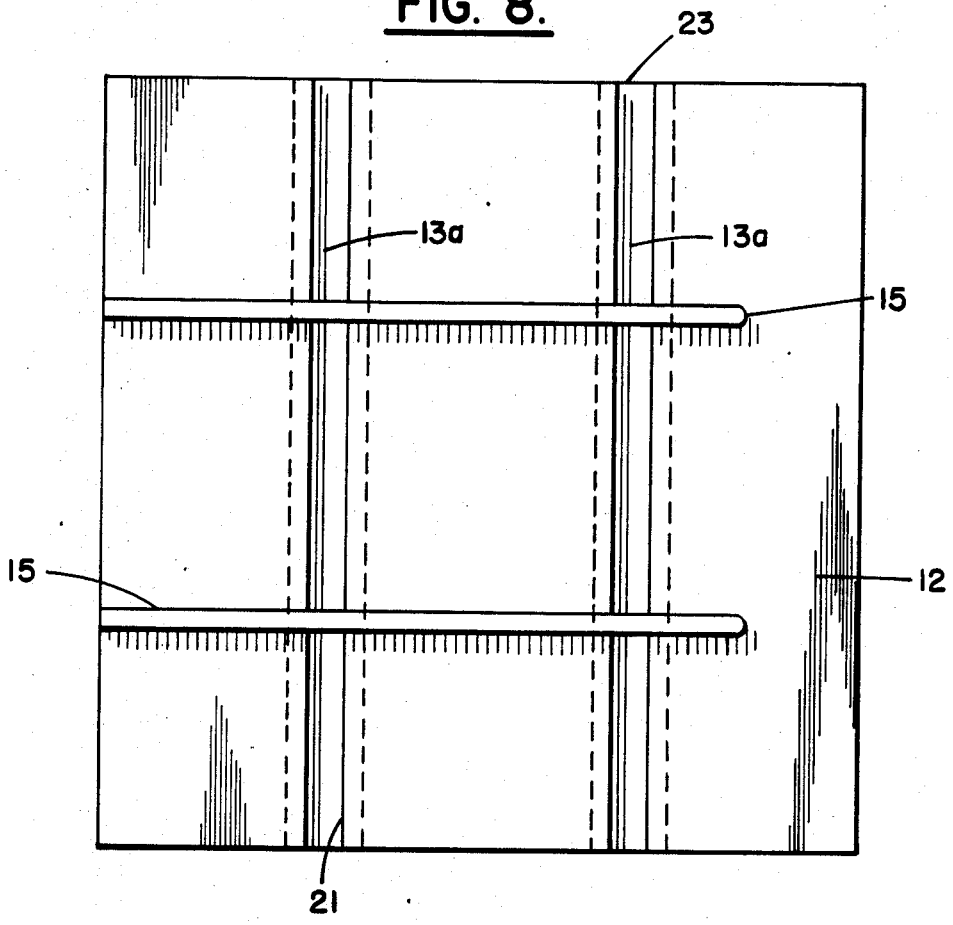
FIG. 7.
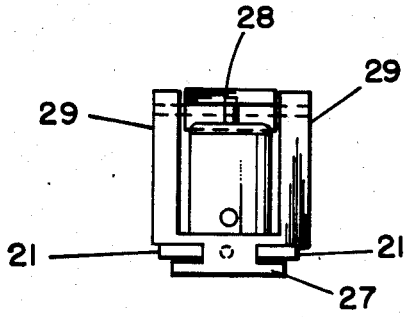
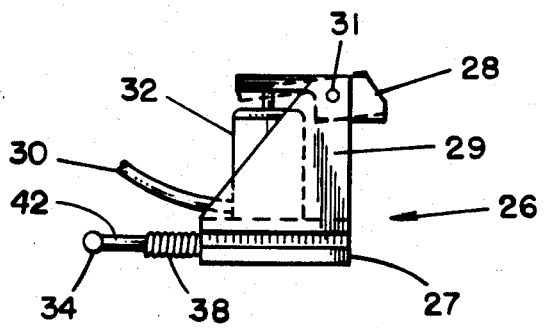
FIG. 5.
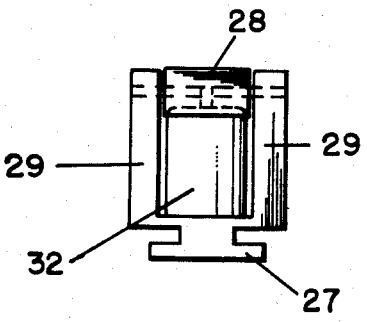
FIG. 6.

QUICK CHANGE DIE RETENTION APPARATUS

This application is a continuation of application Ser. No. 627,164, filed on July 2, 1984, now abandoned.

BACKGROUND OF THE INVENTION

This invention relates in general to apparatus for retaining a die set in a press and in particular to a system for changing die sets in a press.

Punch presses in most metal manufacturing plants utilize a die set which comprises a metal, lower die plate mounted to a bottom plate or bed of a punch press and a similar, upper die plate mounted in vertical alignment with the lower die plate to the upper plate of the punch press. The bottom plate or bed of the press is commonly called a bolster and the upper plate of the press is also known as a ram or master plate. The ram generally lowers repeatedly upon the bolster plate, compressing a work piece between the die halves. The upper die plate of the die set and lower die plate of the die set have fixed thereon, respectively, a male punch and a female die bottom for receiving the punch. Also, the upper and lower die plates are kept in vertical alignment by die rods, also called guide posts, fixed intermediate the plates and along which the upper die plate can travel to compress a work piece placed between the punch and the die. Proper alignment of the die set with respect to the bolster and ram is crucial to efficient and safe operation of the punch press. Proper alignment of the die set on the press orients the working area of the die set with respect to the feeder assembly so that the stock is accurately fed into the press. Further, if the die set is not properly aligned over the vertical and horizontal axis of the press, an unequal burden will be placed on the press and the load will not be evenly distributed across the ram. Proper alignment of the die set in the punch press allows for the necessary slug or scrap clearances after the die has operated on the work piece.

Die sets mounted in a power press are usually changed everytime a different type of press work is desired. Generally, changing a die set on a punch press requires a skilled technician and may take over an hour in time. Once the die set has been changed, a sample run of the press is conducted to make sure the die set is properly aligned.

Conventional methods and apparatus for aligning die sets in a punch press involve the use of bolts and shims to secure the dies to the bolster plate and ram. The alignment procedure involves placing the lower die plate on the bolster and selecting the correct amount of shims for the die depth. Bolts are used to secure the die to the bolster plate by mating the bolts with threaded openings provided in the bolster plate. Until the die set is bolted to the bolster plate, it is able to be moved with respect to it. The upper die plate of the die set is secured to the ram in a similar manner. Since the die set is moveable with respect to the bolster and the ram prior to bolting, proper alignment of the die set is difficult to achieve and is time consuming. Such alignment often requires a skilled technician to set up the press when a die change is necessary. Often, slight misalignment of the dies occurs resulting in the mismanufacture of parts. Thus, not only is a large degree of time required to set up the die sets, but sample runs of parts must be made to insure that there are no misalignments. If the die sets are not properly aligned, the punch press must again be shut down for additional alignment. In a factory that runs a number of punch presses, changing over the die sets on each press can involve a considerable amount of down time to the plant as a whole, especially where each press has a limited run of differing items.

The patent to Nakamura, U.S. Pat. No. 4,397,094, illustrates one method and apparatus for locating a die set in a press, however, it requires the proper alignment of four locating pins in openings on the plates and their assembly with a jig. This involves a substantial amount of effort and time even though it appears to be an improvement over the conventional method.

Thus, there is a need in the field for an apparatus and system for quickly and efficiently changing die sets in a punch press. Further, there is a need in the field for a system that will allow a positive alignment of a die set without the need of a skilled technician and without the need for a sample run to check alignment.

SUMMARY OF THE INVENTION

It is an object of the present invention to provide an apparatus for quickly and efficiently changing the die sets in a punch press.

It is a further object of the present invention to provide a means by which a die set can be aligned in a punch press accurately and quickly upon the insertion of the set into the bolster and ram.

It is another object of the invention to provide a means by which a die set is securely held to a punch press without the use of blocks and shims.

Further objects and advantages of the invention will become apparent as the following description proceeds. The features of novelty which characterize the invention will be pointed out with particularity in the claims annexed to and forming a part of this specification.

The objects of the present invention are accomplished by providing a modified bolster plate and ram with a correspondingly modified die set clamped to the bolster plate and ram with hydraulically activated clamps. The bolster plate of the punch press in the present invention has a pair of parallel T-slots cut therein. Each T-slot is designed to receive a moveable hydraulic clamp, allowing a pair of opposing, hydraulic clamps to be placed on each T-slot of the bolster. The ram is likewise inscribed with a pair of parallel T-slots, each T-slot adapted to receive a moveable hydraulic clamp at each end thereof. Rigidly fixed to the bolster and ram is a key. The key is normal to the T-slots inscribed in the bolster.

The die set has, on the side adjacent the bolster, a keyway inscribed therein extending from an end section of the lower die plate and ending at a prescribed point on the lower die plate. The key on the bolster is designed to fit within the keyway inscribed on the back side of the lower die plate. The key provides a stopping point for the die set as it is inserted onto the bolster and the ram. When the key reaches the end of the keyway, the die is prevented from sliding further into the bolster and ram. By selecting the appropriate length of the inscribed keyway on the back side of the lower die plate, a die set may be quickly aligned by simply locating the key in the keyway and sliding the die set onto the bolster until the key strikes the keyway end. Once the die set is so aligned, the hydraulic clamps will be moved along the T-slots inscribed into the bolster and ram to the die set. Each die plate has a stepped portion cut on each of two opposing sides. The step is designed to receive the clamping member of the hydraulic clamp. The hydraulic clamp is then activated, thereby clamping each die plate to the bolster plate and to the ram. Each hydraulic clamp may be provided with an optional spring-loaded handle which allows the hydraulic clamp to be securely positioned with respect to the die plate surface such that the activation of the hydraulic clamp will insure a securely mounted die plate to the bolster and to the ram. The lower die plate may also have a second keyway cut therein, parallel to the first. The second keyway would mate with a corresponding second key fixed parallel to the first bolster. This second keyway and key arrangement may not be necessary if the single key and keyway arrangement is properly cut in the die.

The hydraulic clamps are operated by a hydraulic pressure supply system. Standard sensing guages may be used to show and determine the pressure in each clamp. The system may be designed such that in the event hydraulic pressure to a clamp is lost, or the pressure drops below a certain level, the entire press will shut down. This will help protect the press and dies from damage due to hydraulic failure and die misalignment. Further, it will prevent damage to the press or the die set in the event of total hydraulic failure of the clamps. An electrical console and control system controls the press and is interconnected to the pressure gauges of the hydraulic system such that the operation of the punch press is not possible until the hydraulic clamps are securely in place or if pressure is lost. Again, this prevents damage to the machine or dies from improper set up and assembly.

BRIEF DESCRIPTION OF THE DRAWINGS

The features of the present invention which are believed to be novel are set forth with particularity in the appended claims. The invention together with further objects and advantages thereof may best be understood by reference to the following description taken in conjunction with the accompanying drawings in the several figures of which like reference numerals identify like elements, and in which:

FIG. 5 is a side elevational view of the hydraulic clamp.

FIG. 6 is a front elevational view of the hydraulic clamp.

FIG. 7 is a back elevational view of the hydraulic clamp.

FIG. 8 is a top view of the bolster plate showing the parallel T-slots inscribed therein and parallel keys fixed thereto.

DETAILED DESCRIPTION

Figure 1:
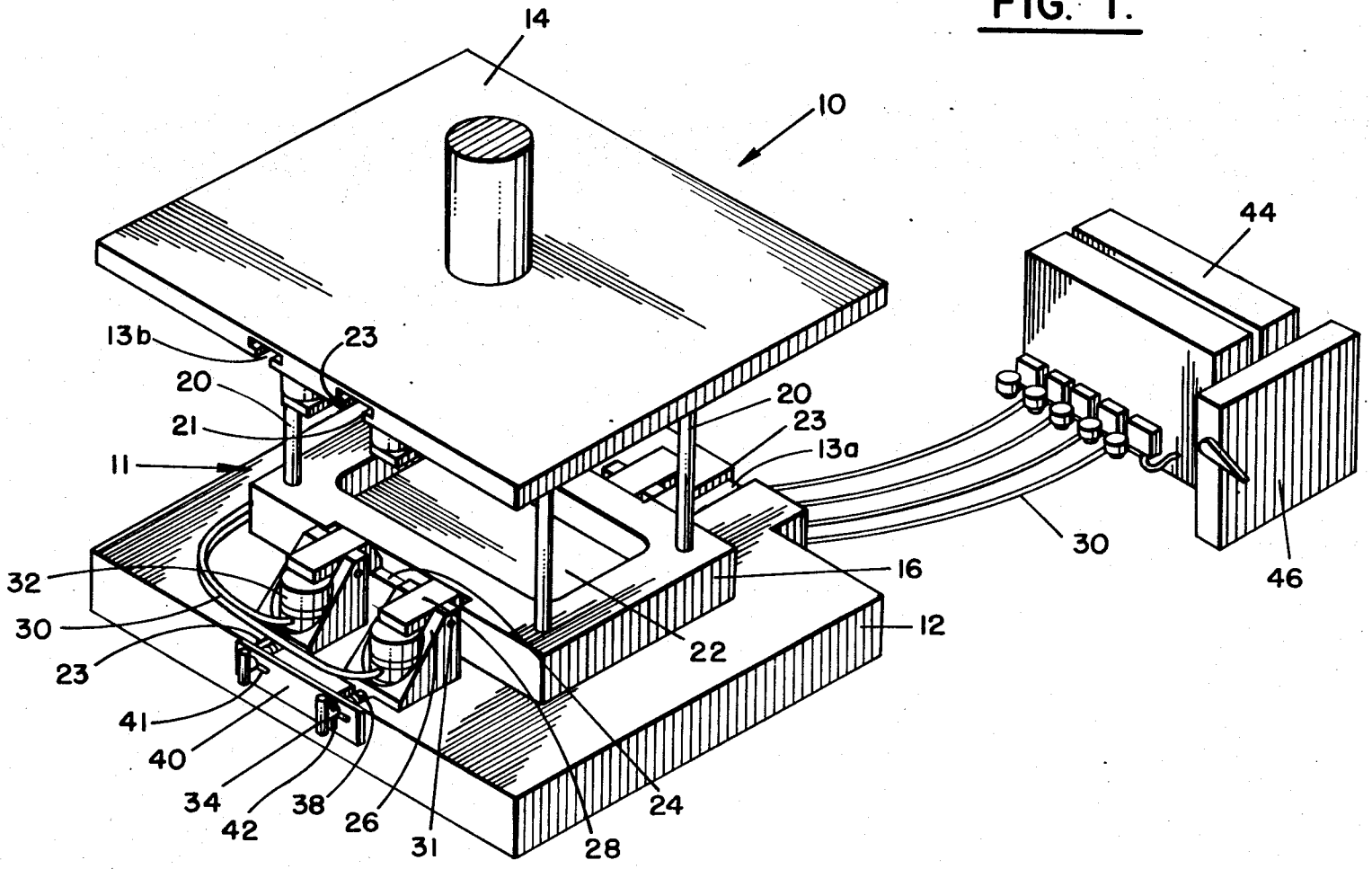
FIG. 1 is a perspective view of the bolster and ram having a die set secured thereon and shown clamped in place with the hydraulic clamps.
Figure 10:
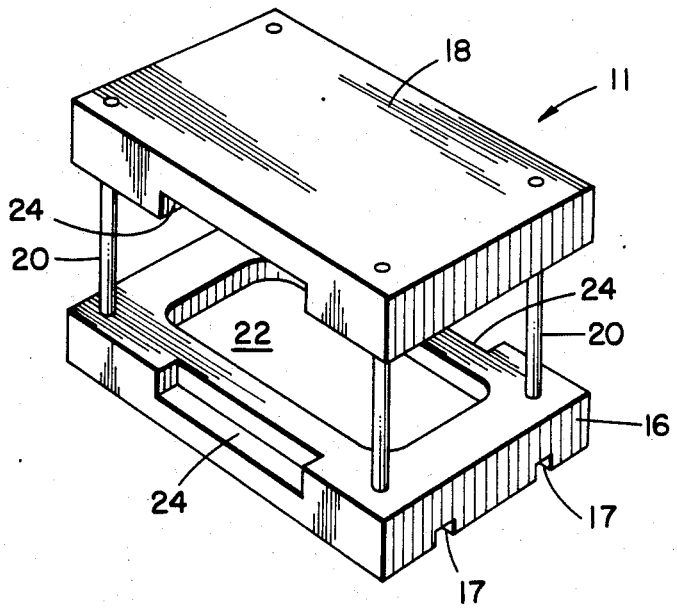
FIG. 10 is a perspective view of the modified die set.

Referring now to FIG. 1, punch press parts 10 are shown in perspective view. Punch press parts 10 include bolster plate 12 mounted to the press (not shown). Master plate or ram 14 is shown in the upper position and in substantial vertical alignment with bolster plate 12. Die set 11 comprises lower die plate 16, shown clamped to bolster plate 12, and upper die plate 18 (not shown) is clamped to ram 14. Upper die plate 18 is similarly clamped to the ram 14 as die plate 16 is to the bolster 12. Die rods 20 extend between upper die plate 18 and lower die plate 16 and provide a means upon which die plate 18 moves up and down on die plate 16 during the operation of press parts 10. Die plate 16 is shown having working part 22 centrally located. Die set 11 is further shown in FIG. 10. Die set 11 has upper die plate 18 with steps 24 therein. Die rods 20 connect upper die plate 18 to lower die plate 16 and allow for vertical, reciprocal movement of upper die plate 18 onto lower die plate 16. Work space 22 is shown on lower die plate 16 as are keyways 17, which will be explained more fully below.

Bolster plate 12 has cut therein a pair of parallel T-slots 13(*a*) spanning the entire width of bolster plate 12. Ram 14 has T-slots 13(*b*) cut therein. The T-slots 13(*b*) on ram 14 are identical in location and size to the T-slots 13(*a*) on bolster 12. As the ram 14 is vertically oriented over bolster 12, T-slots 13(*a*) and 13(*b*) are also in vertical alignment. T-slots 13(*a*) and 13(*b*) have lips 21 which extend the length of each T-slot. Lips 21 retain the hydraulic clamp T-sections 27 therein (shown in FIG. 6).

Lower die plate 16 and upper die plate 18 have steps 24 inscribed therein, on each edge thereof. Step 24 is intended to receive hydraulic clamp 26. Hydraulic clamp 26 is formed with a T-section 27 thereon. T-section 27 fits within T-slot 13 on either of the bolster 12 or ram 14. Retention plate 40 is fixed over T-slot ends 23 on bolster plate 12. A similar retention plate 40 is fitted over keyway ends 23 on the ram 14 (not shown). Retention plate 40 has opening 41 therein through which handle 34 protrudes. Handle 34 interacts with hydraulic clamp 26 and is connected to hydraulic clamp 26. Spring 38 is disposed between hydraulic clamp 26 and retention plate 40 such that a constant, compressive spring force is maintained against the hydraulic clamp 26. When handle 34 is pushed into retention plate 40 and retention pin 42 on handle 34 is fitted into opening 41, the handle 34 is turned approximately a quarter-turn thereby locking handle 34 in place and creating a compression in spring 38. This movement of quarter-turn handle 34 thus compresses spring 38 against hydraulic clamp 26 and insures that clamp member 28 is properly aligned over step 24 of the die plate. This movement insures that hydraulic clamp 26 will securely hold die 16 (or 18) to the bolster plate 12 (or ram 14) when it is activated. When it is desired to change the die set 11, the pressure in hydraulic clamp 26 is relieved and handle 34 is turned to align pin 42 with opening 41. The compressive force of spring 38 will push handle 34 and pin 42 through opening 41, thus relieving the compression force of spring 38. Hydraulic clamp 26 may now be moved from the die plate. This movement of hydraulic clamp 26 will cause clamp member 28 to move off of step 24 allowing the die to be removed, once this procedure has been completed for all of the hydraulic clamps 26.

The arrangement for the ram 14 is identical to that shown on the bolster 12 in FIG. 1. Further, the manner of securing the handle 34 and the clamps 26 is the same as above described. Hydraulic clamp 26 has clamp member 28 and main body 29. Pin 31 connects clamp member 28 to main body 29, however, pin 31 allows clamp member 28 to pivot a small amount with respect to main body 29. Operation of hydraulic piston 32 pivots clamp member 28 with respect to main body 29 along pin 31. Hydraulic line 30 connects the hydraulic piston to the hydraulic pressure supply 44. Hydraulic pressure supply 44 is controlled by the electric console and control 46, and when activated supplies pressure to the hydraulic clamps 26.

Figure 2:
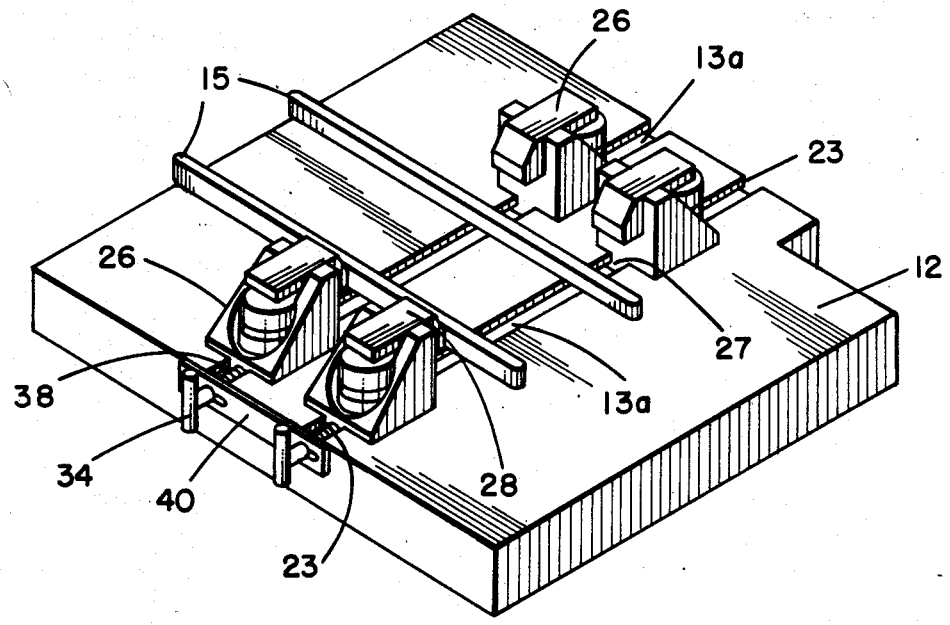
FIG. 2 shows in perspective view the bolster plate with the die set removed, showing parallel T-slots having four hydraulic clamps mounted therein, and parallel keys fixed transversely to the T-slots.

FIG. 2 shows the bolster 12 without the die plate 16 thereon. Bolster 12 has four hydraulic clamps 26 engaged in T-slots 13(*a*). It should be noted that while the bolster 12 is shown in FIG. 2, the identical arrangement for ram 14 applies hereto. Ram 14 has identical T-slots 13(*b*) inscribed therein. Ram 14 has four hydraulic clamps 26 engaged in T-slots 13(*b*) like those shown in FIG. 2. All of the hydraulic clamps 26 are operated by a hydraulic pressure supply 44 and by an electric console and control system 46. Independent operation of each clamp may be provided such that each clamp 26 may be individually clamped onto the respective step 24 of the die plate when it is in the proper position.

FIG. 2 further shows parallel keys 15 fixed to the bolster 12. FIG. 2 shows dual keys 15, however, it should be noted that a single key 15 will be adequate for most applications so long as the corresponding keyway 17 on the bottom side of lower die plate 16 is accurately cut. T-slots 13(*a*) are shown spanning the entire width of bolster 12 with four hydraulic clamps 26 therein. T-sections 27 of clamps 26 are also shown mating in T-slots 13(*a*) thus providing a means of capturing the clamps 26 on bolster 12, yet providing a means for moving clamps 26 along the bolster 12 to reach a die plate 16 placed thereon. Retention plate 40 is shown only on one side of bolster 12 at T-slot ends 23. The opposite side of bolster 12, when fully assembled, would have a second retention plate 40 to interact with handle 34 and clamp 26.

Figure 3:
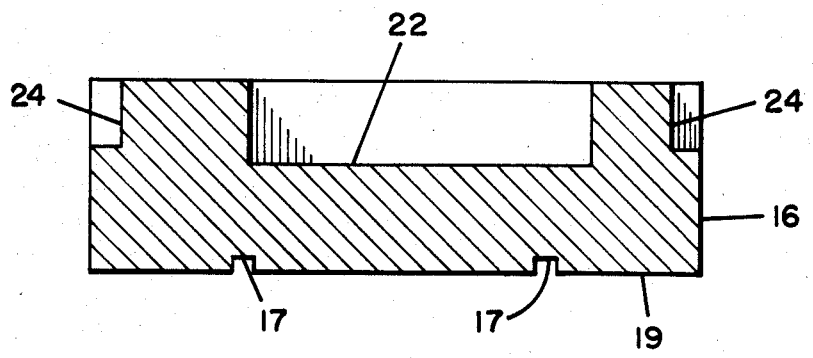
FIG. 3 is a side section view of the lower die plate showing the step portion inscribed therein and parallel keyways inscribed therein.

FIG. 3 in side view shows lower die plate 16 having working part 22 therein. Attention is drawn to the steps 24 inscribed on the sides thereof. The die plate 16 is generally rectangular and the stepped portions 24, in the best mode, contemplate steps 24 inscribed on opposing sides of each die plate

16 and 18. Steps 24 provide a ready means by which clamp member 28 of hydraulic clamp 26 can be located on the die plate and clamped. FIG. 3 further illustrates keyways 17 inscribed on the bottom side 19 of die plate 16. Keyways 17 are cut to match the dimensions of key 15 of FIG. 2. Again, only one keyway 17 may be needed for most applications. The positioning of key 15 on bolster 12 and keyway 17 on die plate 16 control the alignment of the die set 11 with respect to the press parts 10.

Figure 4:
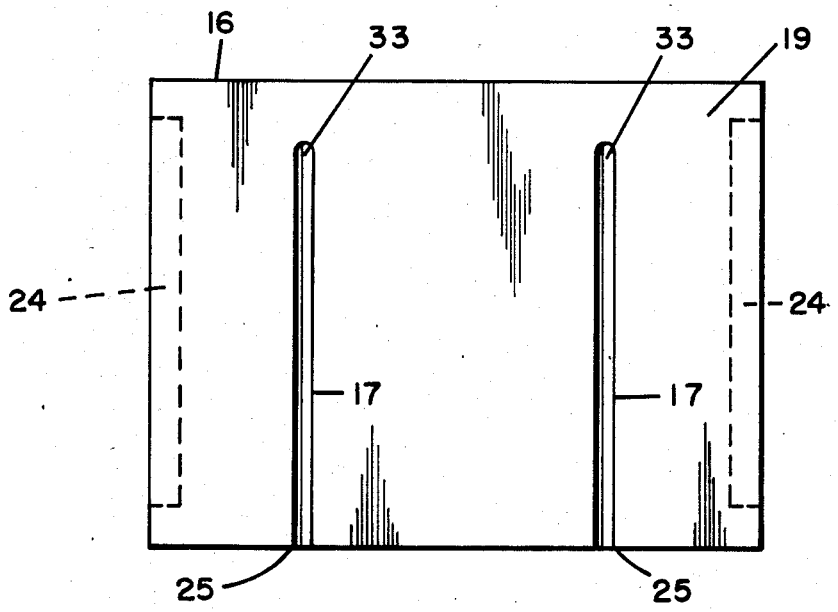
FIG. 4 is a bottom view of the lower die plate illustrating a pair of parallel keyways inscribed therein.

FIG. 4 shows in bottom view the die plate 16. Lower die plate 16 has keyways 17 inscribed on backside 19. As can be seen, these keyways 17 begin on one end 25 of the die plate 16 and extend through the die plate 16 to a predetermined position 33. Both keyways 17 are parallel to one another and it is aniticipated that superior alignment is achieved by providing parallel keyways 17 on the lower die plate 16. Again, an alternative embodiment could provide for a single keyway 17 on the die plate 16, however, it is believed that increased stability and alignment results with dual parallel keyways 17 inscribed on the back side 19 of die plate 16 as shown in FIG. 4.

FIG. 8 illustrates keys 15. These keys are spaced on and rigidly mounted to the bolster 12. Keys 15 are designed to mate with keyways 17 on the die plate 16. The keys 15 provide stops against which keyway ends 33 strike when the die plates 16 and 18 are placed on the bolster 12 and on the ram 14. The length of the keyways 17 in die plate 16 and the fixed location of keys 15 on the bolster 12 provide for the instant and complete location of the die set 11. Keys 15 are rigidly fixed to bolster 12 in any suitable manner. In one embodiment, they are screwed to bolster 12 with flat head screws (not shown), or they may also be welded or brazed thereto.

Multiple die changes may be easily made by simply releasing the pressure of the hydraulic clamps 26 and sliding the old die set 11 off of keys 15. A new die set 11 is then placed on the bolster 12 and ram 14 by sliding the die keyways 17 of the lower die plate 16 along the keys 15, until the keys 15 strike the keyway ends 33 of keyways 17. Each die set 11 is assembled onto the bolster 12 and onto ram 14 in the same manner. So long as the keyways 17 are a constant length for each die set, due to the location of the respective keys 15 on the bolster 12, each die set 11 will always be aligned when keys 15 are inserted into keyways 17 to keyway ends 33. Once aligned, the handles 34 and pins 42 are locked in plate 40 and all hydraulic clamps 26 are thus moved such that clamps 28 are aligned over steps 24. Hydraulic clamps 26 are then activated, thereby securing the lower die plate 16 to the bolster 12 and the upper die plate 18 to the ram 14. Once so clamped, the press 10 is ready for operation. The above provides a quick and efficient means for registering a die set onto a punch press. It is felt that any one of a number of currently available hydraulic supply units would provide sufficient hydraulic pressure to operate the clamps 26. Further, the hydraulic system could be interlocked with the electrical system such that if hydraulic pressure to any of the clamps drops below a predetermined pressure, the power to the entire press would shut off, thereby stopping the entire press operation. This would serve to protect the press and die set and perhaps the operator from injury.

FIG. 5 illustrates in detail a novel clamp 26 having main body 29 and the clamp member 28. Piston 32 is disposed between main body 29 and clamp member 28. Pin 31 secures both clamp member 28 to main body 29 and allows piston 32 to move clamp member 28 a short distance with respect to main body 29. It is anticipated that the movement of clamp member 28 will only be slight in view of the limited range of movement needed to securely clamp die plates 16 or 18 to the bolster plate 12 or the ram 14. By limiting the movement of clamp 28 to a short distance, the die set 11 will always be maintained in the press 10, even if hydraulic pressure to the clamps 26 is lost. This serves as an additional safety means for the system. FIG. 6 shows the relationship of clamp member 28 to main body 29 in more detail. FIG. 7 illustrates the relationship between the T-section 27 of main body 29 and lips 21 of T-slot 13.

Figure 9:
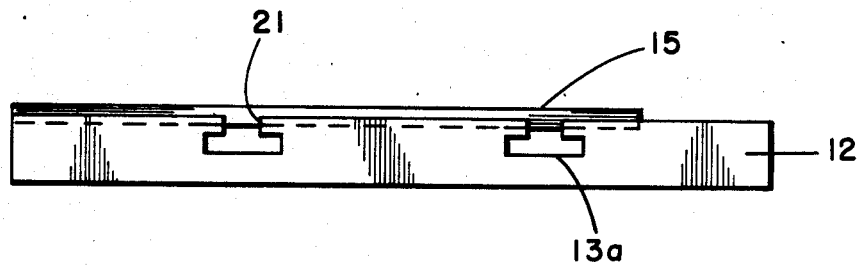
FIG. 9 is a side elevational view of the bolster.

In FIG. 9, T-slots 13(*a*) in bolster 12 (and T-slots 13(*b*) in ram 14) are illustrated in side view. Of course, it is anticipated that the shape of the T-slot 13 can be changed and need not be the precise T-shape having lips 21 as shown. Any type of shape would be sufficient so long as it captively held hydraulic clamp 26 to either the bolster plate 12 or ram 14. Likewise, while only one keyway 17 may be necessary in the die plate 16 to provide a suitable mating with the bolster 12, a single T-slot 13 and a single hydraulic clamp 26 per side of the bolster plate 12 or ram 14 may be sufficient for some applications.

Figure 3A:
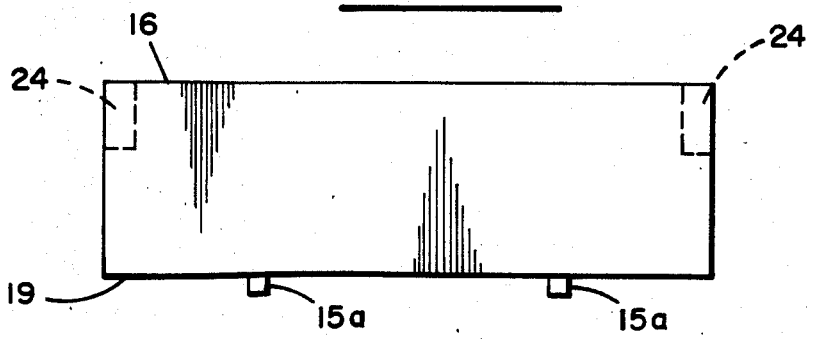
FIG. 3*a* is a side view of an alternative embodiment of the invention.

In FIG. 3A an alternative die plate 16 is shown. While the keys 17 have been previously shown to be rigidly fixed to bolster 12, it is possible to have keys 15 fixed to the lower die plate 16 with a corresponding keyway 17 inscribed in the bolster plate 12. The keys 15 would still mate with the keyway 17. The arrangement would simply be reversed from that previously disclosed. This alternative would give the advantage of providing a flat bolster 12 thereby allowing it to be used with traditional die sets also. Likewise, the T-slots 13 could be provided in the hydraulic clamps 26 with the corresponding T-section raised from the bolster 12 and ram 14. While this also is another embodiment, it is felt that the raised T-section on the bolster 12 and ram 14 would interfere with the die set alignment.

The handle 34, retention plate 40, and spring 38 arrangement may be optional. The hydraulic clamps 26 may be arranged without the use of the handle 34 arrangement in T-slots 13. Care must be taken to insure that clamp members 28 are sufficiently aligned over steps 24 to provide adequate clamping of the die plates.

While the keys 15 on bolster 12 are shown as extending from an edge of the bolster 12 and terminating at a predetermined position where it is desired to locate the die set 11 with respect to the bolster 12 and ram 14, an alternative embodiment would contemplate the key 15 extending over a reduced portion of the bolster. Further, the stepped portion 24 need not span the length of the die plate shown. Individual steps 24 could be developed to receive the individual clamps members 28 of the hydraulic clamp 26. Further, other means may be used to clamp the die set 11 into place rather than hydraulic clamps. For example, a manually operated clamp could be used.

The alignment of the die set described above is generally free from the errors inherent in the conventional system. The misalignment of the dies previously experienced in conventional systems is greatly reduced if not eliminated entirely. The time that the plant or factory would normally spend in change over of die sets and down time will be greatly reduced thereby increasing the overall efficiency of the plants.

Many modifications and variations of the present invention are possible. Some have been described above. It is therefor to be understood that within the scope and spirit of the appended claims, the invention may be practiced otherwise than as specifically described. Further, it is intended that the subject matter in the above depiction shall be interpreted as illustrative and not in a limiting sense.

We claim:

1. A method for aligning a die set having upper and lower die plates in a press said method comprising the steps of placing the die set on a bolster of the press; mating a key rigidly fixed to said bolster with a keyway inscribed in the lower die plate of the die set; sliding the die set on the bolster with the key mated in the keyway until the key is stopped at a predetermined position in the keyway; clamping the die set to the press by means of a pair of clamps movably mounted in a slot inscribed in the bolster and a slot in the ram where said slots are perpendicular to the key and the keyway.

2. Apparatus for aligning dies in a press having a bolster and a ram, said apparatus comprising a die set with an upper die plate vertically mounted to the ram for reciprocal movement over a lower die plate mounted to the bolster, said lower die plate having at least one keyway inscribed therein on a side adjacent the bolster, said keyway inscribed to a predetermined position on the lower die plate; a key communicating with said keyway, said key rigidly affixed to the press on the bolster, said key ending at a predetermined position on the bolster such that when the keyway of the die plate is mated with the key of the bolster to the predetermined positions of the keyway and the key the die set is aligned in the press; a stepped portion on opposite sides of each die plate and means for clamping said die plates to the bolster and ram when said plates have been aligned, said clamping means clamping the die plate at the stepped portions of each die plate, said clamping means comprising a pair of parallel T-shaped slots inscribed in the bolster perpendicular to the key, and a corresponding pair of parallel T-shaped slots inscribed in the ram, a pair of oppositely mounted hydraulic clamps, each having a T-shaped section protruding therefrom moveably mounted in said slots in the bolster such that each pair of said clamps face each other in a slot and communicate with stepped portions of the lower die plate, and a pair of oppositely mounted hydraulic clamps each having a T-shaped section protruding therefrom moveably mounted in said slots in the ram such that each pair of said clamps face each other in a slot and communicate with stepped portions in the upper die plate, clamping the die set in its aligned position in the press.

3. Apparatus for aligning and clamping dies in a press, said press having a bolster and a ram and said apparatus comprising a pair of parallel slots inscribed in the bolster and across a face thereof; and means for clamping a die set to the bolster said clamping means captively mounted for movement along the face of said bolster in each said slot; a pair of parallel slots inscribed in the ram and across a face thereof; and means for clamping a die set to the ram, said clamping means captively mounted for movement along the face of said ram in each said slot; said clamping means comprising hydraulically operated clamps captively mounted in said slots, each said clamp having a clamping member designed such that it interacts with a stepped portion in a die set when said die set is aligned on the bolster to clamp the die set in its aligned position in the press said die set comprising an upper die plate adjacent the ram and a lower die plate adjacent the bolster, said lower die plate having a keyway inscribed therein, said keyway beginning at an end of the plate and projecting a predetermined distance therein; a key mounted on the bolster and corresponding to the keyway in the lower die plate, said key mounted perpendicular to the parallel slots in the bolster, such that when the keyway of the lower die plate is mated to the key of the bolster the die set is aligned in a position to be clamped and to receive a die.

4. Apparatus for aligning dies in a press said press having a bolster and a ram, said apparatus comprising a die set with an upper die plate vertically mounted for reciprocal movement over a lower die plate, said lower die plate having rigidly mounted thereon on a side adjacent the press, a key, said key located on said lower die plate at a predetermined position; a keyway communicating with said key, said keyway inscribed on the bolster and ending at a predetermined position on the bolster such that when the key of the lower die plate is mated with the keyway of the bolster to the predetermined positions the die set is aligned in the press; means for clamping the aligned die set to the press comprising a pair of hydraulically operated clamps, each having a clamping portion and a T-shaped section protruding therefrom, said clamps mounted to the bolster along a T-shaped slot formed in said bolster perpendicular to said keyway such that the T-shaped sections of the hydraulic clamps mate with the T-shaped slot allowing the clamps to move across the bolster, a stepped portion located on opposite sides of the lower die plate, each stepped portion receiving the clamping portion of the clamping means to clamp the die set to the press.

* * * * *